United States Patent [19]

Smith

[11] 4,339,981

[45] Jul. 20, 1982

[54] SOFT BODY GUITAR

[76] Inventor: Walter E. Smith, P.O. Box 707, Weiser, Id. 83672

[21] Appl. No.: 139,357

[22] Filed: Apr. 11, 1980

[51] Int. Cl.[3] ..... G10D 1/08

[52] U.S. Cl. ..... 84/291; 84/267; 84/452 R

[58] Field of Search ..... 84/267, 275, 290, 291, 84/452

[56] References Cited

U.S. PATENT DOCUMENTS

| | | | |
|---|---|---|---|
| 636,692 | 11/1899 | Patch | 84/291 |
| 2,837,953 | 6/1958 | Baschet | 84/275 |
| 4,185,534 | 1/1980 | Cove | 84/291 |
| 4,240,319 | 12/1980 | Soupios | 84/291 X |
| 4,290,336 | 9/1981 | Peavey | 84/291 |

FOREIGN PATENT DOCUMENTS

| | | | |
|---|---|---|---|
| 164345 | 10/1905 | Fed. Rep. of Germany | 84/291 |
| 2263995 | 7/1974 | Fed. Rep. of Germany | 84/291 |

*Primary Examiner*—Lawrence R. Franklin
*Attorney, Agent, or Firm*—Lyon & Lyon

[57] ABSTRACT

A guitar is provided with a soft pillow-like body or cushion instead of the large sound box of a Spanish-type guitar or the substantially flat non-yielding body of an electric guitar. The soft cushion avoids uncomfortable localized contact between the body of the musician and parts of the guitar, and it promotes more secure holding by the musician for better performance on the instrument. Also, the cushion is sufficiently flexible so that the stem and neck of the guitar may be suitably positioned for playing by a musician in either standing or sitting position.

14 Claims, 6 Drawing Figures

FIG. 1.
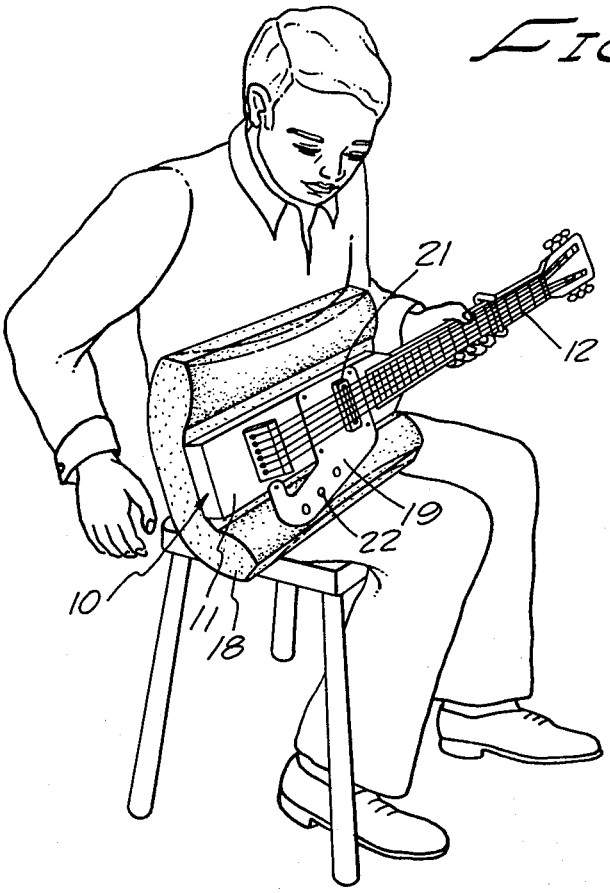
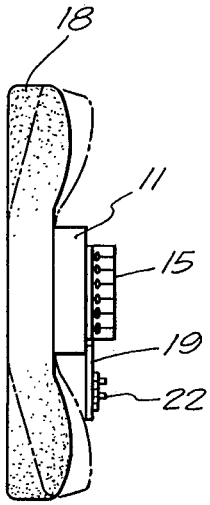
FIG. 3.
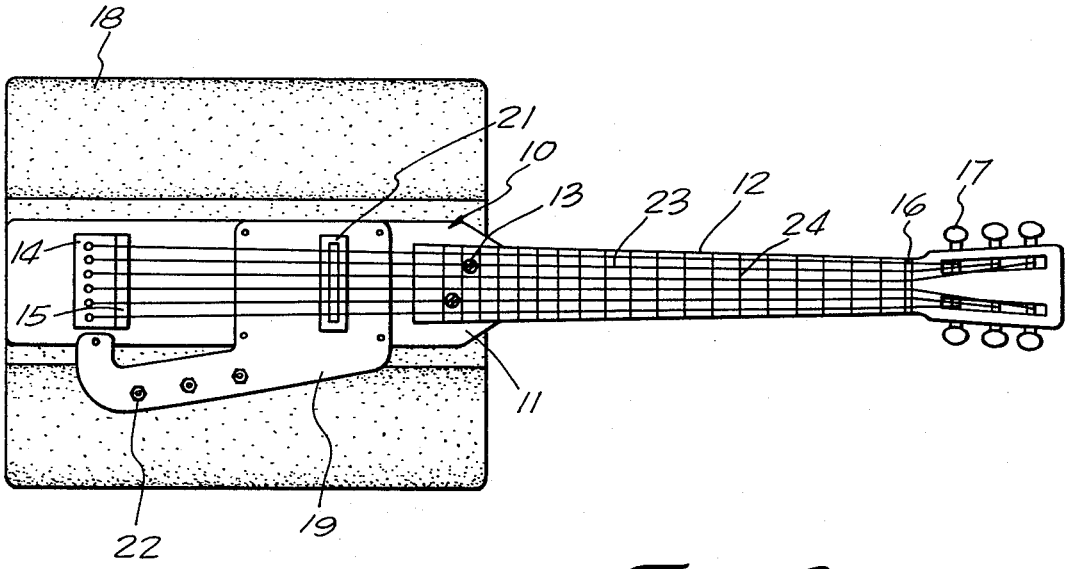
FIG. 2.

SOFT BODY GUITAR

This invention relates to stringed musical instruments such as guitars, and is particularly directed to a soft body guitar in which the large acoustical sound box of a Spanish-type guitar or the substantially flat body of an electric guitar is replaced by a pillow-like cushion which is flexible and yielding to conform to the contours of a human body in either a standing or sitting position. By conforming to the body of the player, the guitar is held more securely for optimum performance.

Conventional Spanish-type guitars are often played by a musician in standing position, and this often requires a support strap passing behind the neck of the musician. The acoustical sound box contacts the body of the musician at one or more locations and the area of contact is localized and uncomfortable. An electric guitar, that is, a guitar with an electrical sound pickup system, does not require an acoustical sound box but the shape of the substantially flat body also contacts the musician at localized places which become uncomfortable. A neck strap need not be used when the musician is in sitting position, playing either the Spanish-type guitar with acoustical sound box, or the electric guitar with the electrical sound pickup. However, in either case, the guitar contacts localized areas on the musician's body, making it uncomfortable to hold the guitar in the same position for an extended period of time.

When the guitar is of the Hawaiian type, that is, when the strings are contacted by a slide bar, the guitar is generally supported on the lap of the musician in sitting position so that sliding movement of the metal bar is facilitated.

It is an object of this invention to overcome uncomfortable localized contacts between parts of the guitar and localized areas on the body of the musician. This is accomplished by substituting a soft pillow-like cushion for the acoustical sound box of the Spanish-type guitar or the flat body of the electric guitar. The cushion is sufficiently flexible and yielding to conform to the contours of the human body in standing position or sitting position, and permits angular adjustment of the guitar neck so that the strings may be brought into suitable position for manual sliding of a Hawaiian-type slide bar along the plane of the strings.

The soft pillow-like cushion may be filled with any conventional material, or it may be pneumatically inflatable to the desired extent. It may even contain many small pieces of light-weight foam material. Its thickness may vary from side to side or top to bottom, or both. In any case, the pillow-like cushion should be adapted to conform to the portion of the human body which it contacts.

Other and more detailed objects and advantages will appear hereinafter.

In the drawings:

FIG. 1 is a perspective view showing a preferred form of this invention, and showing it positioned on the lap of a seated musician.

FIG. 2 is a front elevation of the device.

FIG. 3 is an end view.

Figure 5:
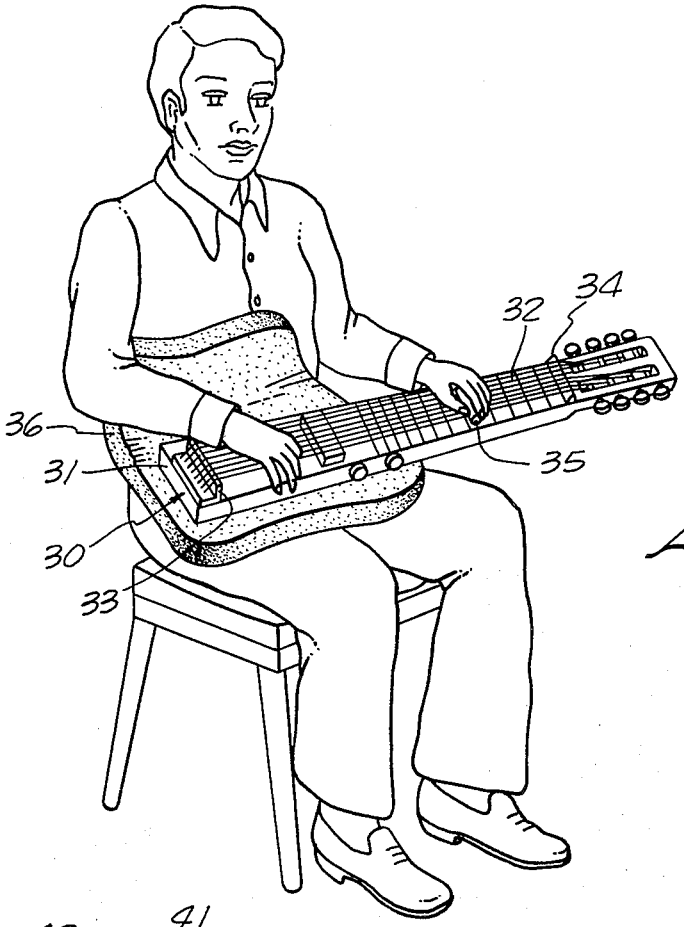
FIG. 5 shows another modification, positioned on the lap of a seated musician.

Referring to the drawings, the guitar generally designated 10 and shown in FIGS. 1–3 has a stem 11 provided with a laterally extending neck 12. Threaded fastenings 13 secure the two parts of the stem together. The stem 11 carries the usual string anchor 14 and bridge 15 as well as the nut 16 and tuning pegs 17.

In accordance with this invention, a soft pillow-like cushion 18 is fixed to the stem 11 and is shaped to conform to the contours of the human body in sitting position. Thus, as shown in FIG. 1, the cushion, or support member 18 conforms to the shape of the thigh of the seated musician and also conforms to the anterior portion of the body above the waist. The guitar 10 is thus comfortable to hold in desired position.

A plate 19 is fixed to the stem 11 and projects to one side thereof to limit the extent of yielding movement of the cushion 18. The electrical sound pickup unit 21 and the controls 22 therefor may all be mounted on the plate 19.

The guitar strings 23 extend from the string anchor 14 to the tuning pegs 17, and the bridge 15 and nut 16 determine the plane of the strings. The guitar 10 as shown in FIGS. 1–3 is provided with the usual frets 24 so that the strings may be finger-pressed against them in the customary fashion.

In the modified form of the invention shown in FIG. 5, the guitar generally designated 30 has a stem 31 with strings 32 extending over the bridge 33 and nut 34 to define the plane of the strings. A slide bar 35 of the Hawaiian type slides on the strings. The soft pillow-like cushion 36 conforms to the body contours although it may initially be substantially flat. The cushion 36 is flexible enough so that it permits angular adjustment of the guitar stem and neck so that the strings may be brought into a suitable position for manual sliding of the bar 35 along the plane of the strings 32.

Figure 4:
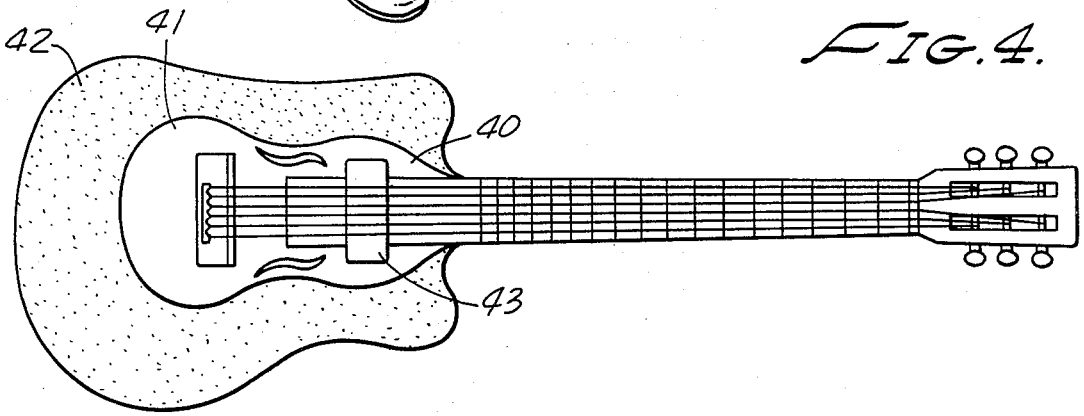
FIG. 4 is a front elevation showing a modification.

In the modified form of the invention shown in FIG. 4, the stem 40 has an enlarged portion 41 which is encompassed by the soft pillow-like cushion 42 affixed thereto. If desired, the cushion 42 may extend over the back surface of the enlarged portion 41 of the stem 40. The stem 40 may be hollow to provide a sound box or it may utilize an electrical sound pickup 43 or both. In other respects, the device shown in FIG. 4 is similar to those described above.

Figure 6:
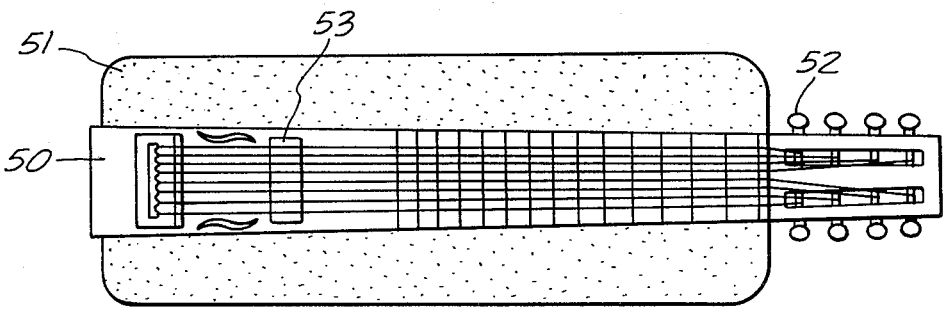
FIG. 6 is a front elevation showing a further modification.

In the modified form of the invention shown in FIG. 6, the stem 50 is mounted on the soft pillow-like cushion 51 which extends for the major portion of the length of the device. The stem 50 is preferably hollow to form a sound box, but it may also be provided with an elctrical sound pickup 53. In other respects, the form of the invention shown in FIG. 6 is similar to that previously described.

The soft pillow-like cushion shown in each of the forms of the invention yield to conform to the contours of the human body. It is therefore comfortable to maintain in playing position. This is a very important consideration in general, and is critical for some handicapped musicians confined to wheel chairs. The wheel chair generally does not permit the musician to maintain a Spanish-type guitar in playing position and it also interferes with proper positioning of a Hawaiian-type guitar.

Having fully described my invention, it is to be understood that I am not to be limited to the details herein set forth but that my invention is of the full scope of the appended claims.

I claim:

1. In a musical stringed instrument such as a guitar, the combination of: a soft support member having flexibility to conform to the contours of a human body in either standing or sitting position, said support member having internal soft structure for maintaining its overall shape and thickness, a stem mounted on said support member, and a bridge and a nut mounted at spaced locations on said stem defining a plane for strings.

2. The combination set forth in claim 1 in which said internal means comprises flexible material extending continuously between the outer surfaces of the support member.

3. The combination set forth in claim 1 in which the soft support member is sufficiently flexible to permit angular adjustment of the neck so that the strings may be brought into position for manual sliding of a Hawaiian-type slide bar along the plane of the strings.

4. The combination set forth in claim 1 in which said stem is hollow.

5. The combination set forth in claim 1 in which said neck is provided with frets, or fret marks.

6. The combination set forth in claim 1 in which said internal means comprises light-weight foam material.

7. In a musical stringed instrument such as a guitar, the combination of: a soft, pillow-like, flexible support member having flexibility to conform to the contours of the lap and anterior portions of a human body in sitting position, said support member being initially curved for surface contact with the chest or abdomen of the human body, said support member having internal soft structure for maintaining its overall shape and thickness, a stem secured to said support member, a bridge and a nut mounted at spaced locations on said stem, said bridge being positioned near said support member and said nut being positioned remotely therefrom near the projecting end of said stem, said nut and bridge defining a plane for guitar strings, a sound pickup device on the stem located adjacent the said plane, the support member being sufficiently flexible to permit angular adjustment of the stem so that the strings may be brought into substantially horizontal position for manual sliding of a Hawaiian-type slide bar along the plane of the strings.

8. In a musical stringed instrument such as a guitar, the combination of: a soft flexible support member adapted to conform to the contours of a human body in sitting position, said support member having internal soft structure for maintaining its overall shape and thickness, a stem mounted on said support member, a bridge and a nut mounted at spaced locations on said stem, said nut and bridge defining a plane for strings, and means secured to the stem and projecting therefrom for limiting the extent of flexing of said support member.

9. The combination set forth in claim 8 in which the latter said means comprises a plate projecting from said stem.

10. The combination set forth in claim 9 including a sound pickup device on the stem, and controls for said sound pickup device mounted on said plate.

11. In a guitar or similar stringed instrument having strings, and means for supporting the strings; a flexible support member for said means including sufficient internal flexible material for inherently controlling the shape of the support member while being yieldable to accommodate the contours of a human body or adjacent structure when the instrument is played while the flexible support member is in contact with the human body or adjacent structure.

12. In the guitar as defined in claim 11 in which said support member has outer surfaces and said flexible material extends substantially continuously between the outer surfaces of said support member.

13. In the guitar as defined in claim 12 wherein said flexible material comprises light-weight foam material.

14. In the guitar defined in claim 11 wherein said means for supporting the strings includes a stem, and wherein said flexible support member is secured relative to said stem to support the same.

* * * * *